United States Patent [19]

Martin

[11] Patent Number: 4,541,814

[45] Date of Patent: Sep. 17, 1985

[54] RADIO CONTROLLED VEHICLE WITHIN A SPHERE

[76] Inventor: John E. Martin, 5 Belfast Rd., Timonium, Md. 21093

[21] Appl. No.: 564,838

[22] Filed: Dec. 23, 1983

[51] Int. Cl.[4] ..... A63H 17/00

[52] U.S. Cl. ..... 446/456

[58] Field of Search ..... 446/443, 454, 456, 458, 446/461, 462, 463, 431, 433, 437, 448, 457; 280/206; 180/10, 21

[56] References Cited

U.S. PATENT DOCUMENTS 1,263,262 4/1918 McFaul ..... 446/458

FOREIGN PATENT DOCUMENTS 1292441 10/1972 United Kingdom ..... 280/206

*Primary Examiner*—F. Barry Shay

*Attorney, Agent, or Firm*—John F. McClellan, Sr.

[57] ABSTRACT

A radio controlled vehicle within a sphere has two wheels touching the sphere at diametrically opposite points, with the mass of the body of the vehicle hanging underslung from the wheels; to preserve a constant length always fitting the sphere interior the wheel which steers has a steering axis substantially congruent with the sphere diameter on which the wheels touch the sphere; when confronted with an obstacle stopping roll of the sphere in a given direction, the vehicle climbs the interior wall of the sphere and either tumbles backwards or to the side, or may perform an Immelmann maneuver, depending on course taken within the sphere by the wheels which are free to travel in any part of the sphere interior.

1 Claim, 9 Drawing Figures

RADIO CONTROLLED VEHICLE WITHIN A SPHERE

Cross-reference is made to my co-pending applications: Ser. No. 427,890, filed Sept. 29, 1982, U.S. Pat. No. 4,438,588, for REMOTE CONTROL BALL and Ser. No. 448,421, filed Dec. 10, 1982, U.S. Pat. No. 4,471,567, for TWO-WAY OPERATING BALL ENCLOSED VEHICLE.

FIELD OF THE INVENTION

This invention relates generally to powered spheres and particularly to a sphere with a radio controllable power plant therein for use as an amusement device and for other practical purposes.

SUMMARY OF THE INVENTION

The invention in a preferred embodiment includes a sphere with a radio controllable and steerable two-wheel vehicle inside having first and second wheels contacting a sphere at diametrically opposed points in the inner circumference. The vehicle may be in the nature of a motorcycle-like apparatus with a heavy portion thereof underslung as a counterweight for stability.

OBJECTS OF THE INVENTION

Objects of the invention include provision of a system of the vehicle-in-sphere type in which the vehicle has two wheels freely contacting the interior surface of the sphere, one at either end of a diameter of the sphere, a low center of gravity so that the vehicle body normally hangs between the wheels, and radio control of a battery and motor subsystem powering the vehicle in forward and reverse and steering.

Further objects are to provide a system as described in which the vehicle upon running into an obstacle can be self-protecting and self-freeing without extra mechanism for same in that there is little shock that could damage the vehicle, or furniture because the vehicle will continue to travel up the wall of the sphere until it either tumbles back over itself or tumbles to the side, or performs an Immelmann maneuver, causing a new tracking angle relative to the sphere and running off in a new direction. Alternatively the operator can reverse the drive and back the sphere out of difficulty. The side-tumbling and Immelmann give a drastic wrenching causing change in direction not found in other devices of the type, because of the free pivoting provided by having only two wheels.

Yet further objects are to provide a system as described in which the vehicle is relatively inexpensive, being comprised of parts already on the market, and in addition to the forward/reverse and steering has two speeds and an off-position controllable easily by switches in the sphere, using a slim stick through a small hole, if desired, without removal of a large access-cap provided;

in which the steering can make a circle as small as eight feet (2.5 m) and has the general "feel" characteristics of controlling a radio-controlled "jeep" or the like;

in which control of the vehicle is simple enough for a six-year old child to learn quickly and interesting enough for derby type, or obstacle course type games fascinating children and adults alike; and in which the vehicle can easily use a transparent plastic sphere or, for indoors, a pasteboard sphere.

BRIEF DESCRIPTION OF THE DRAWINGS

The above and other objects of the invention will become more readily apparent from the following description; in the drawings like reference characters refer to like parts.

DETAILED DESCRIPTION

Figure 1:
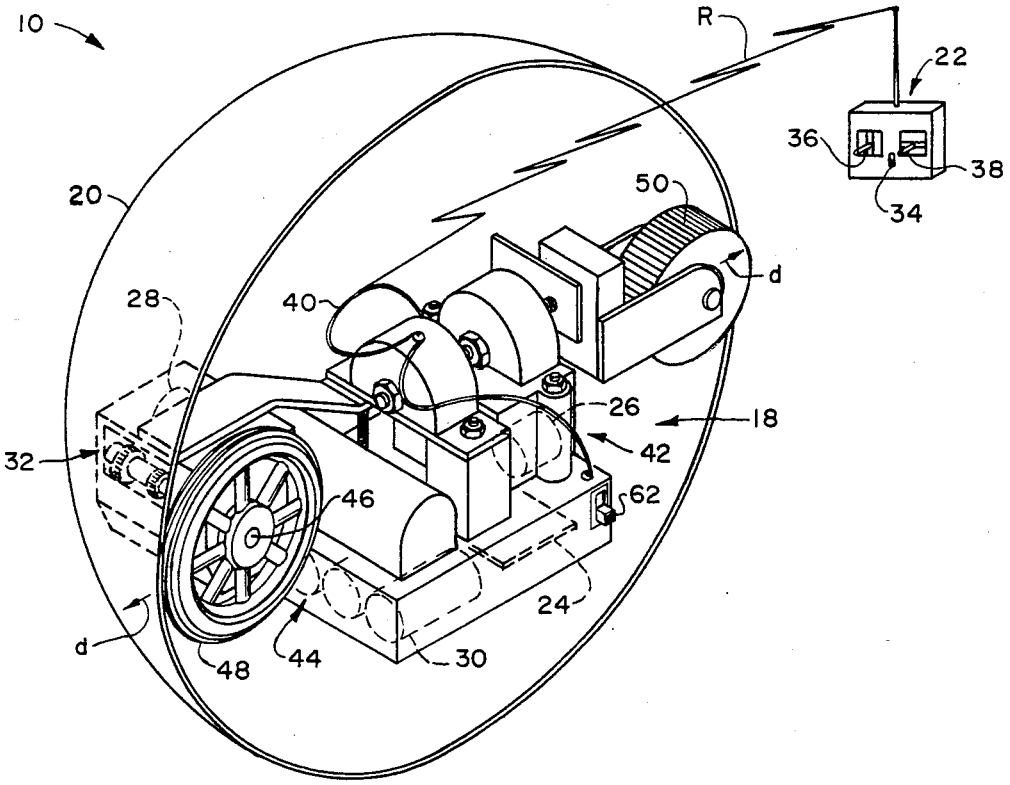
FIG. 1 is a perspective view of the overall system with one-half of the sphere removed.
Figure 2:
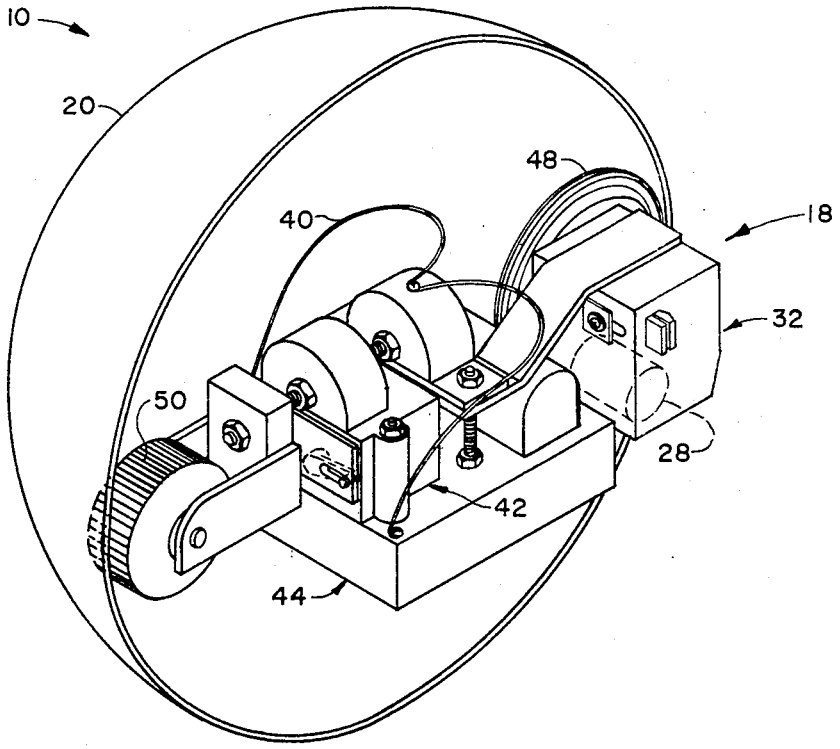
FIG. 2 is a similar view of the vehicle headed in the opposite direction.

FIGS. 1 and 2 show the system in embodiment 10; a vehicle 18 in a sphere 20, except that one-half of the sphere has been removed for exposition. The two halves of the sphere may screw together, snap together or be cemented together so long as the seam between them is flush, outside and in. As shown, clear, hard thermoplastic is preferred, but the sphere may be of paperboard as will be seen, or of any other suitably strong, rigid material permeable by radio waves R to permit remote control. As indicated, the sphere inner wall is substantially concentric with the outer wall.

Remote control transmitter 22 may be that available commercially along with the responsive receiver 24 and steering subsystem 42 and associated power section 30 and drive subsystem 32, from Shinsei Corporation, Cerritos, Calif., as Model No. 1125 radio controlled toy jeep. The transmitter has an on-off switch 34, forward-/reverse joystick type switch 36 and proportional joystick-type steering switch 38. The signals are picked up by antenna 40 on the vehicle which receives them from the transmitter which in turn appropriately connects steering motor 26 and drive motor 28 with the power section 30, a battery pack, as required.

No claim is made to any part of the radio control and motor and gear system. It is entirely commercially available as indicated.

However, the physical relation of the steering subsystem 42 and drive subsystem 32 to the frame 44, and the frame in part, are new. The steering axis is preferably substantially along the diameter "d" (FIG. 1) passing through the plane of the axle 46; the rest of the vehicle hangs from the driving wheel 48 and steering wheel 50, preferably substantially below them for stability of the vehicle through low center of gravity. The frame may extend one way more than the other as necessary for lateral balance. It serves as means for holding the steering wheel and drive wheel at a spacing providing for the steering and drive wheel to hold the vehicle in rattle-free relation to the sphere, or substantially rattle-free relation. This spacing or fit to the sphere of the two wheels further maintains steering fairly free and uniform, because the geometry is constant or nearly so, the turning axis of the steering preferably being coincident with the diameter passing through the tandem wheels, as indicated. This favorable disposition of the steering axis permits the steering wheel to be broad or wide as indicated, if desired, with a cylindrical periphery.

Figure 3:
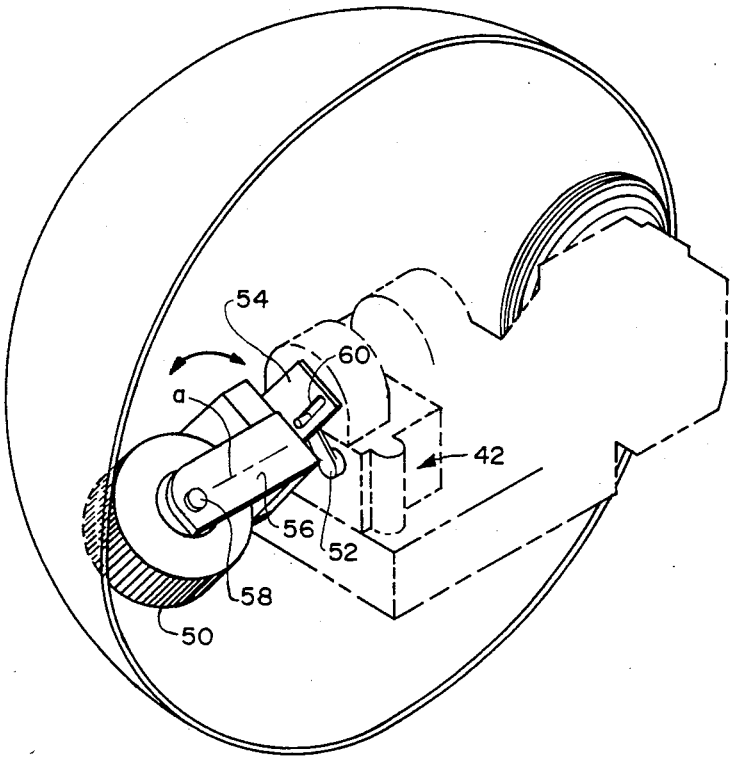
FIG. 3 is a fragmentary detail viewed in the direction of FIG. 2 and showing steering details.

FIG. 3 diagrams the steering action. A crank 52 from steering subsystem 42 turns a steering arm 54 fixed to steering yoke 56, which mounts steering wheel 50 by means of axle 58, and rotates the yoke (arrow) about yoke axis "a". Slot 60 may be provided to compensate for any lack of congruence between the axes of the yoke 56 and crank 52.

Figure 4:
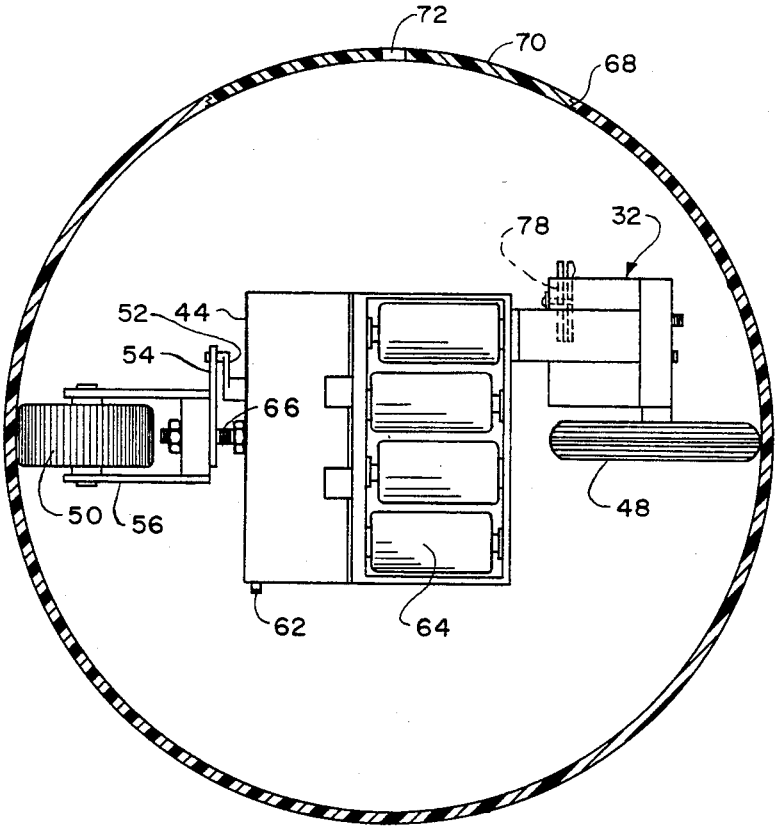
FIG. 4 is a bottom plan view with the battery cover and one-half the sphere removed.

FIG. 4 shows in bottom plan view the steering wheel 50, yoke 56, yoke axle 66, steering arm 54, crank 52, frame 44, on-off switch 62, batteries 64, drive subsection gear box 32 and drive wheel 48.

In addition, the view shows, screwed-in-place to the sphere in threads 68, the cover plate 70 and optional access hole 72 for a stick to actuate switch 62, and/or shift gears by sliding the gear sleeve 78 indicated. The access hole should be small enough to permit free running of the steering and drive wheels (which may be of plastic or hard rubber) across it, but large enough for passage of a stick. The wheels may be one inch (2.5 cm) to two inches (5 cm) in diameter and the hole $\frac{1}{4}$ inch (0.6 cm) in diameter.

Figure 5:
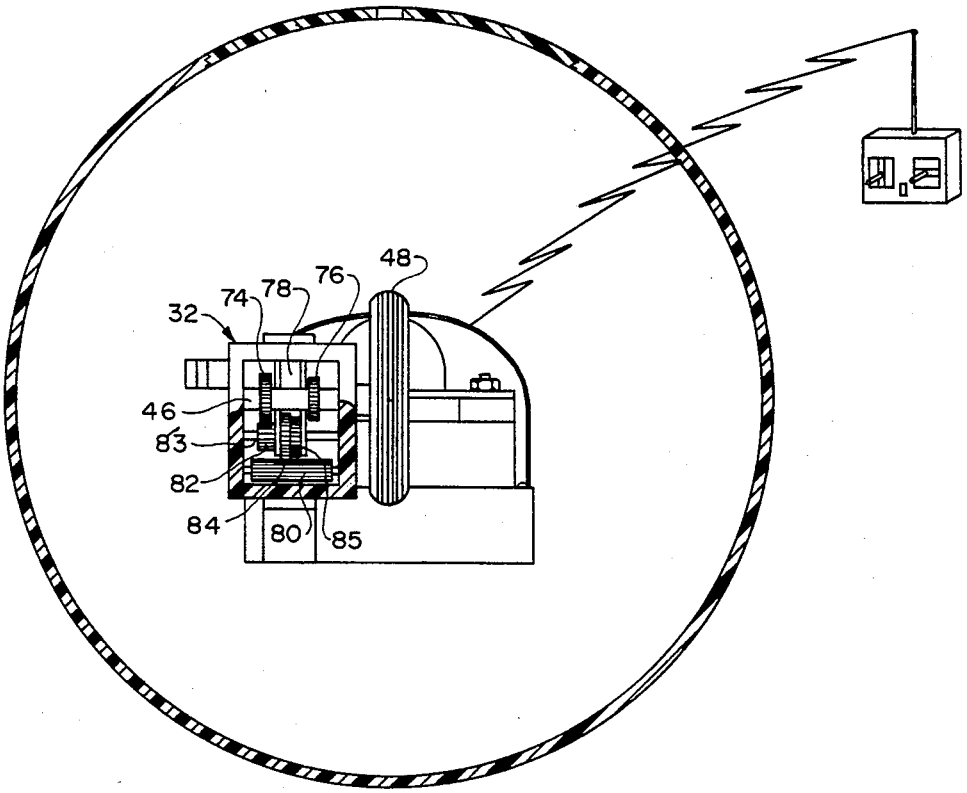
FIG. 5 is a rear elevational view of the system with one-half the sphere removed.

FIG. 5 shows in rear elevational view the speed-change gear-shift subsystem 32 in which motor driven gear 80 drives large driving gear 84 which is molded to small gears 82 and 85, which slide on shaft 83, by movement of gear sleeve 78. Gears 82 and 85 drive large gear 74 and small gear 76 which drives axle 46 which drives wheel 48.

The conventional provisions are entirely part of the commercially obtained unit described and no claim is made to them, and like the other commercial subsystems described can be substituted by equivalent provisions of which there are a number on the market for toy jeeps, trucks and the like.

Figure 6:
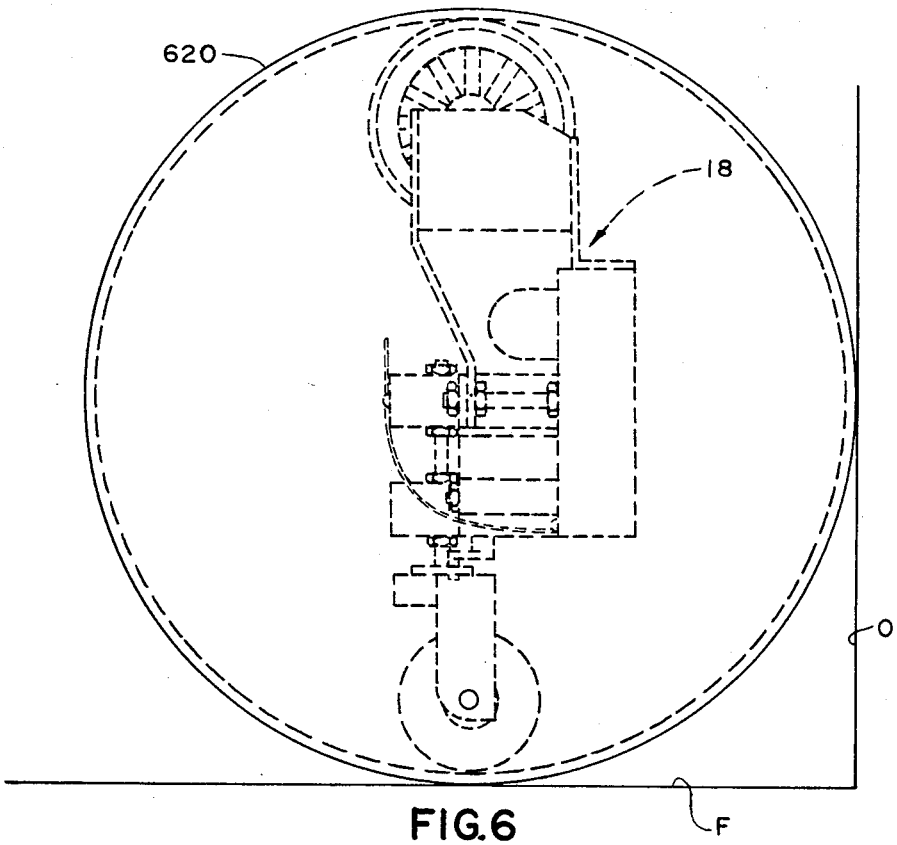
FIG. 6 is a partially phantom elevational detail showing end-over-end tumbling position.

FIG. 6 shows a variation of the sphere, a paperboard sphere 620, which can in operation produce an element of mystery because the vehicle 18 inside is invisible. Also, the paperboard is relatively cheaper, and is softer than plastic so that it will tend to mar furniture less, if at all. It is easily obtainable because cardboard shpheres for globes will serve. In any case, the sphere may be about 12 inches (30 cm) in inside diameter.

In the position shown, the vehicle is tumbling back over itself as result of the sphere's striking an obstruction O. A floor is indicated at F. The tumbling will tend to take the sphere away from the obstacle.

Figure 7:
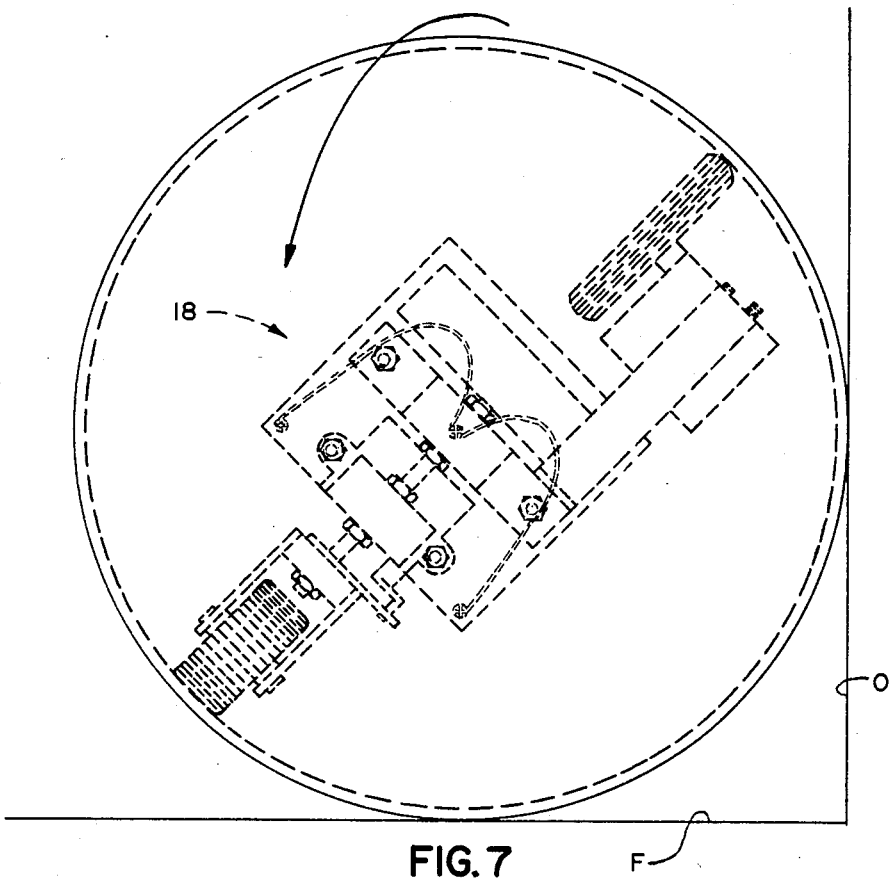
FIG. 7 is a partially phantom elevational detail showing side-tumbling position.

FIG. 7 is like FIG. 6 except that the vehicle 18 is flipping sideways as result of imperfect balance on climbing the sphere interior wall, removing the sphere from position blocked by the obstacle O.

Figure 8:
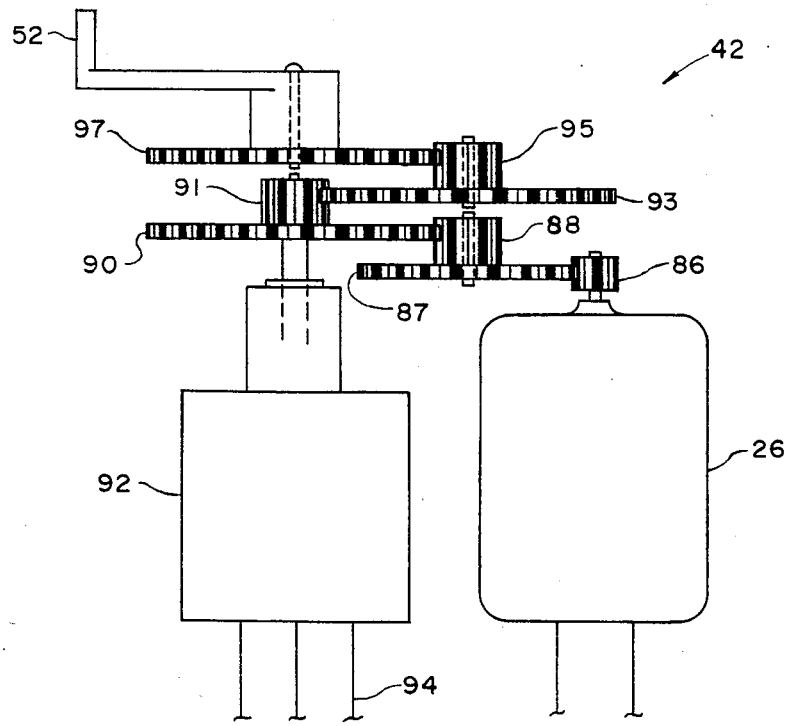
FIG. 8 is a diagram of an output gear section.

FIG. 8 shows a typical commercial steering subassembly 42, applied as purchased, to the present invention.

Motor 26 drives shaft pinion 86, which drives gear 87, which drives shaft pinion 88, which drives gear 90, which drives shaft pinion 91, which drives gear 93, which drives shaft pinion 95, which drives gear 97, which rotates steering crank 52. Take-off gearing 90 proportionally rotates potentiometer 92 which through wires 94 provides the necessary feedback indicating position.

Figure 9:
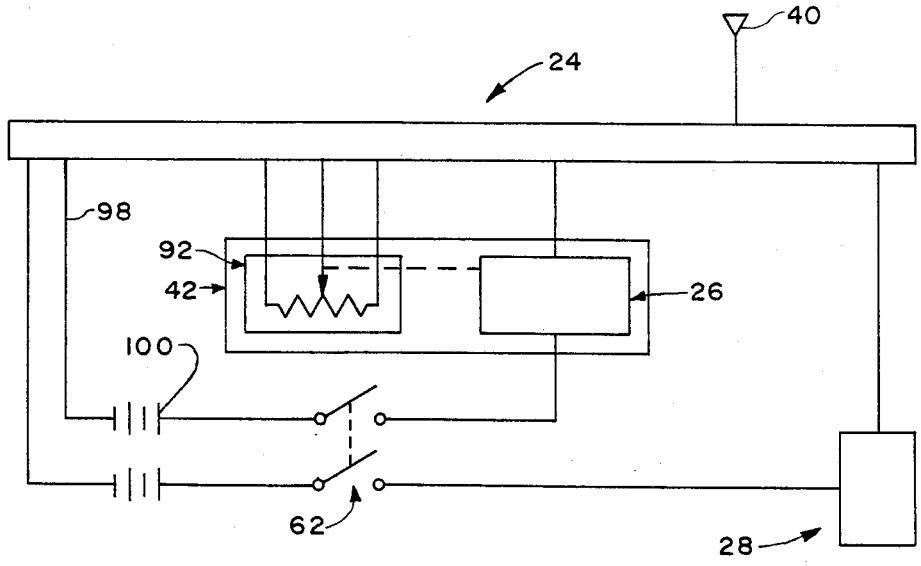
FIG. 9 is a block diagram.

FIG. 9 diagrams the overall on-board electrical subassembly; in the steering subsystem 42 are the steering motor 26 and potentiometer 92; to these is connected the receiving section which may be in the form of a printed circuit board 24 to which section are connected the antenna 40, drive motor 28, power leads 98 from batteries 100, and power switch 62.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of radio controlled, wheeled vehicle-within-sphere, said sphere having an inner surface substantially concentric with the outer surface thereof; the improvement comprising in combination: the vehicle having only two wheels: a steering wheel and a drive wheel, means for holding said steering wheel and drive wheel at a spacing providing for said steering wheel and drive wheel to hold the vehicle in rattle-free relation to the sphere at all orientations of said steering wheel; said radio control providing for turning said steering wheel in steering said vehicle; means for maintaining said rattle-free relation while permitting freely turning said steering wheel in steering said vehicle, said means for holding comprising a frame holding said steering wheel and drive wheel substantially in tandem and said spacing being such that said steering wheel and drive wheel are simultaneously in contact with said sphere inner surface at opposite ends of a diameter of said sphere, said means for maintaining comprising said turning being about an axis, said axis being substantially along said diameter, and said frame being substantially underslung relative to said steering wheel and said drive wheel.

* * * * *